US008317017B2

(12) United States Patent
Edwards et al.

(10) Patent No.: US 8,317,017 B2
(45) Date of Patent: Nov. 27, 2012

(54) ARTICLE OF PACKAGING

(75) Inventors: Ian Edwards, Newtownards (GB); Donna Jackson, Bangor (GB)

(73) Assignee: MSO Cleland Limited, Belfast (GB)

( * ) Notice: Subject to any disclaimer, the term of this patent is extended or adjusted under 35 U.S.C. 154(b) by 88 days.

(21) Appl. No.: 12/500,125

(22) Filed: Jul. 9, 2009

(65) Prior Publication Data

US 2010/0006631 A1 Jan. 14, 2010

(30) Foreign Application Priority Data

Jul. 9, 2008 (GB) ..... 0812538.7

(51) Int. Cl.
*B65D 69/00* (2006.01)

(52) U.S. Cl. ..... 206/232; 206/782

(58) Field of Classification Search ..... 206/232, 206/831, 772, 773, 774, 782, 777, 775, 769; 229/221, 243, 122, 160.01, 160.1, 162; 40/312, 40/313

See application file for complete search history.

(56) References Cited

U.S. PATENT DOCUMENTS 2,177,918 A * 10/1939 Vogt et al. ..... 229/117.27
3,147,856 A * 9/1964 Lightner et al. ..... 206/232
3,207,411 A * 9/1965 Farquhar ..... 229/162.3
4,838,424 A * 6/1989 Petzelt ..... 206/459.5
5,009,518 A * 4/1991 Faltynek ..... 383/106
5,226,532 A * 7/1993 Davidson et al. ..... 206/232
6,155,422 A * 12/2000 Kaminski ..... 206/459.5
6,393,707 B1 * 5/2002 Maffei ..... 33/1 SD
6,474,542 B1 * 11/2002 Chagnon et al. ..... 229/242
6,892,876 B1 * 5/2005 Aubry et al. ..... 206/232
7,036,715 B2 * 5/2006 Lo Duca ..... 229/120.18
7,563,468 B2 * 7/2009 Bougoulas et al. ..... 426/5

FOREIGN PATENT DOCUMENTS

CH 639340 A5 * 11/1983

* cited by examiner

*Primary Examiner* — David Fidei

(74) *Attorney, Agent, or Firm* — Sullivan & Worcester LLP; Christopher T. McWhinney

(57) ABSTRACT

An article of packaging in the form of a carton having an information-bearing insert enclosed within a substantially closed chamber defined by at least one side wall portion of the carton and a further panel facing an inner face of said at least one side wall portion, said side wall portion having a plurality of pre-cut tear lines or perforations defining an openable tab or flap for gaining access to said chamber and to the insert located therein, wherein said chamber is not accessible from a loading opening of the carton such that the chamber does not interfere with the loading of a product into the carton.

16 Claims, 7 Drawing Sheets

ARTICLE OF PACKAGING

BACKGROUND OF THE INVENTION

1. Field of the Invention

This invention relates to an article of packaging, and in particular to a carton for pharmaceutical products having means for incorporating a leaflet or booklet within the carton to be readily accessible without disturbing the contents of the carton and without interfering with the loading of products into the carton.

2. Description of Related Art

Many products are packaged in boxes or cartons folded from flat cardboard blanks. The exterior of the packaging is typically printed with branding and indicia identifying the product and instructions and information on the use of the product. Particularly in the case of a pharmaceutical product, there is often insufficient space on the exterior of the carton to print all of the required written information relevant to the product, such as dosing instructions and health warnings which may be required to satisfy legislative and product liability requirements, particularly where the same information must be provided in several languages. It is therefore often desirable to include an information bearing insert, such as a folded leaflet or booklet, within the carton along with the product.

Such inserts are generally loaded into the cartons during the packaging process. However, the insertion of a separate insert into the carton during packaging of the product can lead to a number of problems. The inserts and cartons must be supplied to the packaging apparatus separately in coordinated processes, requiring duplicate ordering and stock control requirements and more complex packaging processes. In addition, it becomes necessary to verify that each carton is loaded with the correct insert relevant to the packaged product.

EP 0 911 266 discloses a known carton for packaging pharmaceutical products, wherein a chamber is provided inside the carton, defined by an internal wall and an outer wall of the carton, the outer wall being provided with pre-cut tear lines to define an openable tab or flap for gaining access to the leaflet without unsealing a closure lid of the carton. The insert can be adhered to the flat blank prior to assembly of the carton. Therefore, this arrangement provides the advantage that the insert be supplied with the carton, avoiding the need for the insert to be introduced to the carton during packaging of the product, with the resulting risk that the insert may be omitted or the wrong insert may be supplied.

However, a problem with the arrangement disclosed in EP 0 911 266 is that the insert receiving chamber can interfere with the loading of the product into the carton due to the existence of a gap between the internal and outer walls adjacent the loading opening of the carton.

SUMMARY OF THE INVENTION

According to the present invention there is provided an article of packaging in the form of a carton having an information-bearing insert enclosed within a substantially closed chamber defined by at least one side wall portion of the carton and a further panel facing an inner face of said at least one side wall portion, said side wall portion having a plurality of pre-cut tear lines or perforations defining an openable tab or flap for gaining access to said chamber and to the insert located therein, wherein said chamber is not accessible from a loading opening of the carton such that the chamber does not interfere with the loading of a product into the carton.

In one embodiment, said further panel comprises a further wall portion of the carton extending from a side of said side wall portion adjacent a loading opening of the carton, and separated from the side wall portion by a fold line to lie parallel to said side wall adjacent an inner face thereof. Preferably said insert is affixed to a face of said further wall portion facing said side wall portion.

In an alternative embodiment, said further panel comprises a separate sheet or panel adhered to an inner face of said side wall portion around a peripheral edge of said separate sheet or panel to define said closed chamber therebetween. Preferably the peripheral edge of said separate sheet or panel is adhered to said side wall portion of the carton around said openable tab or flap to enclose said openable tab or flap within the bounds of said peripheral edge. Preferably said insert is affixed to a face of said separate sheet or panel facing said side wall portion. Said further panel may comprise a section of the insert, for example an enlarged backing sheet of the insert.

Preferably said insert comprises a multi-page booklet.

The carton is preferably assembled from a suitably shaped blank cut from a sheet of material, such as cardboard.

The insert may be attached to the carton during formation of the latter by folding and gluing of a blank. Alternatively, the insert may be attached to a carton blank, either prior to or after cutting of the blank from a sheet, and the blank then assembled to form the carton.

The assembled carton, with the insert, may be supplied to the product manufacturer in collapsed form, the carton being erected and filled as part of the packaging process.

The carton may be provided with a first opening or window through which a portion of the insert is visible in the assembled carton. Said portion may carry, for example, an identification code, enabling the presence and content of the insert to be checked. Preferably said first opening or window is defined by a first cut-out provided in said at least one side wall portion of the carton, more preferably in said openable tab or flap, arranged to overlay said portion of the insert in the assembled carton.

The carton may be provided with a second opening or window through which a portion of a product contained within the carton is visible in the assembled and packed carton. Preferably said second opening or window is provided in said at least one side wall portion of the carton, more preferably in said openable tab or flap.

Where said further panel comprises a further wall portion of the carton, said second opening or window may be defined by a second cut-out formed in said at least one side wall portion and a third cut-out formed in said further wall portion, said third cut-out being superimposed with said second cut-out in the assembled carton to enable said portion of the contents of the carton to be viewed within the carton.

Where said further panel comprises a separate sheet or panel adhered to an inner face of said side wall portion, said second opening or window may be defined by a second cut-out formed in said at least one side wall portion and a transparent region of said separate sheet or panel substantially aligned with and overlying said first cut-out. Alternatively said second opening or window may be defined by a second cut-out formed in said at least one side wall portion and a third cut-out formed in said separate sheet or panel substantially aligned with said first cut-out.

According to a second aspect of the present invention, there is provided an article of packaging in the form of a carton having an information-bearing insert enclosed within a substantially closed chamber defined by at least one side wall portion of the carton and a further panel facing an inner face of said at least one side wall portion, said side wall portion having a plurality of pre-cut tear lines or perforations defining an openable tab or flap for gaining access to said chamber and to the insert located therein, said at least one side wall portion of the carton being provided with a first window or aperture for viewing a portion of the insert therebeneath, a second window or aperture being provided in a wall portion of the carton for viewing a portion of the contents of the carton.

Preferably said second window or aperture is provided in said side wall portion of the carton, spaced from said first window or aperture. Preferably said second window or aperture is aligned with a further window or aperture provided in said further panel. Preferably said further window comprises a transparent portion of said further panel. Alternatively said further window comprises an aperture in said further panel arranged to be aligned with said second window or aperture.

BRIEF DESCRIPTION OF THE FIGURES

Embodiments of the present invention will now be described, by way of example only, with reference to the accompanying drawings, in which.

DETAILED DESCRIPTION OF THE INVENTION

Figure 1:
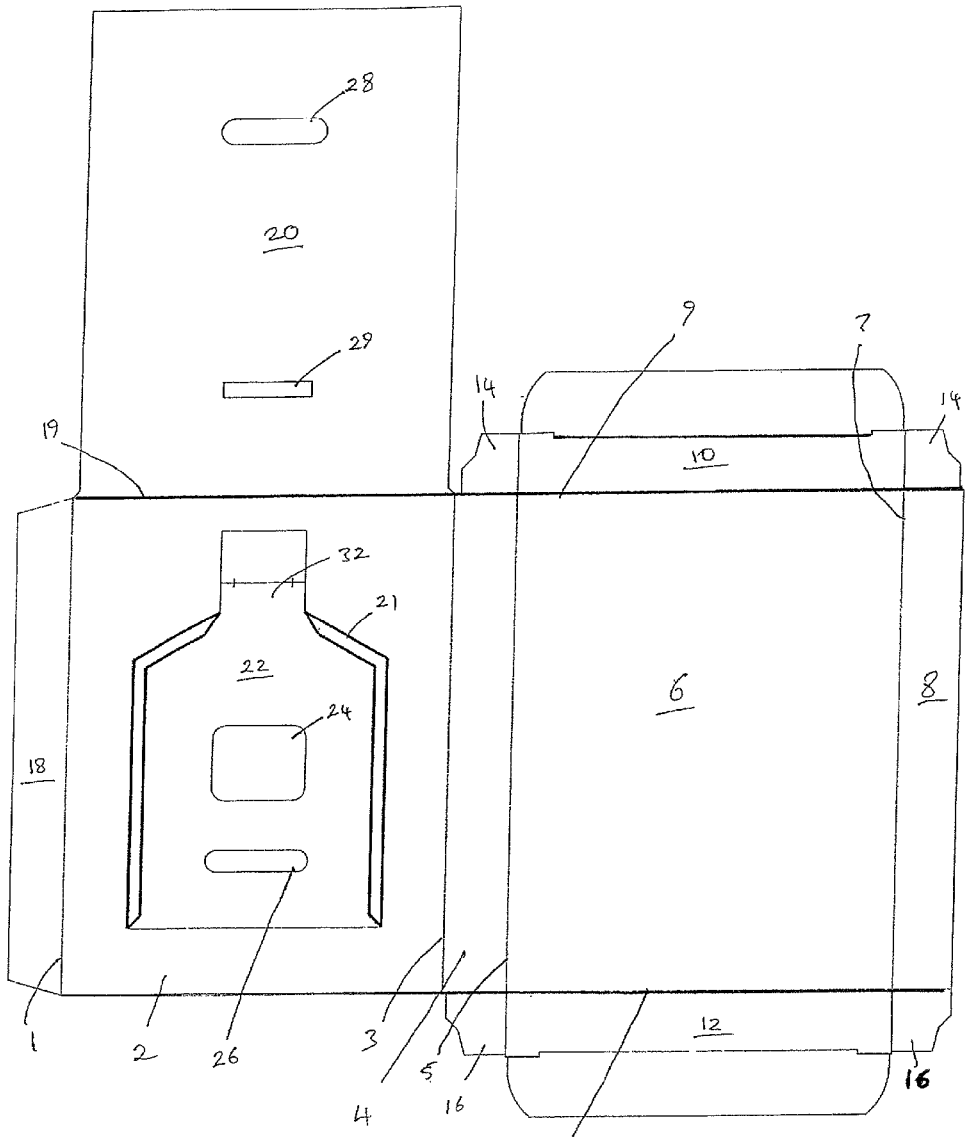
FIG. 1 is a plan view of a flat blank for forming a carton according to a first embodiment of the present invention.

A carton in accordance with a first embodiment of the present invention is formed from a blank as illustrated in FIG. 1. Each blank comprises card sheet having creased parallel longitudinal fold lines 1,3,5,7 defining parallel wall portions 2,4,6,8 and further transverse fold lines 9,11 defining a top closure flap 10 and a bottom closure flap 12 extending from upper and lower sides of the third wall portion 6.

Top and bottom side flaps 14,16 are present at the top and bottom of two of the wall portions 4,8, and a side flap 18 extends along the long edge of the first wall portion 2. Finally, a further panel 20 extends from the top edge of the first wall portion 2, separated therefrom by a transverse fold line 19. The further panel 10 is foldable about fold line 19 to lie against the first wall portion 2 to define a closed chamber or envelope therebetween for receiving an information bearing insert 30, as will be described below in more detail.

Figure 3:
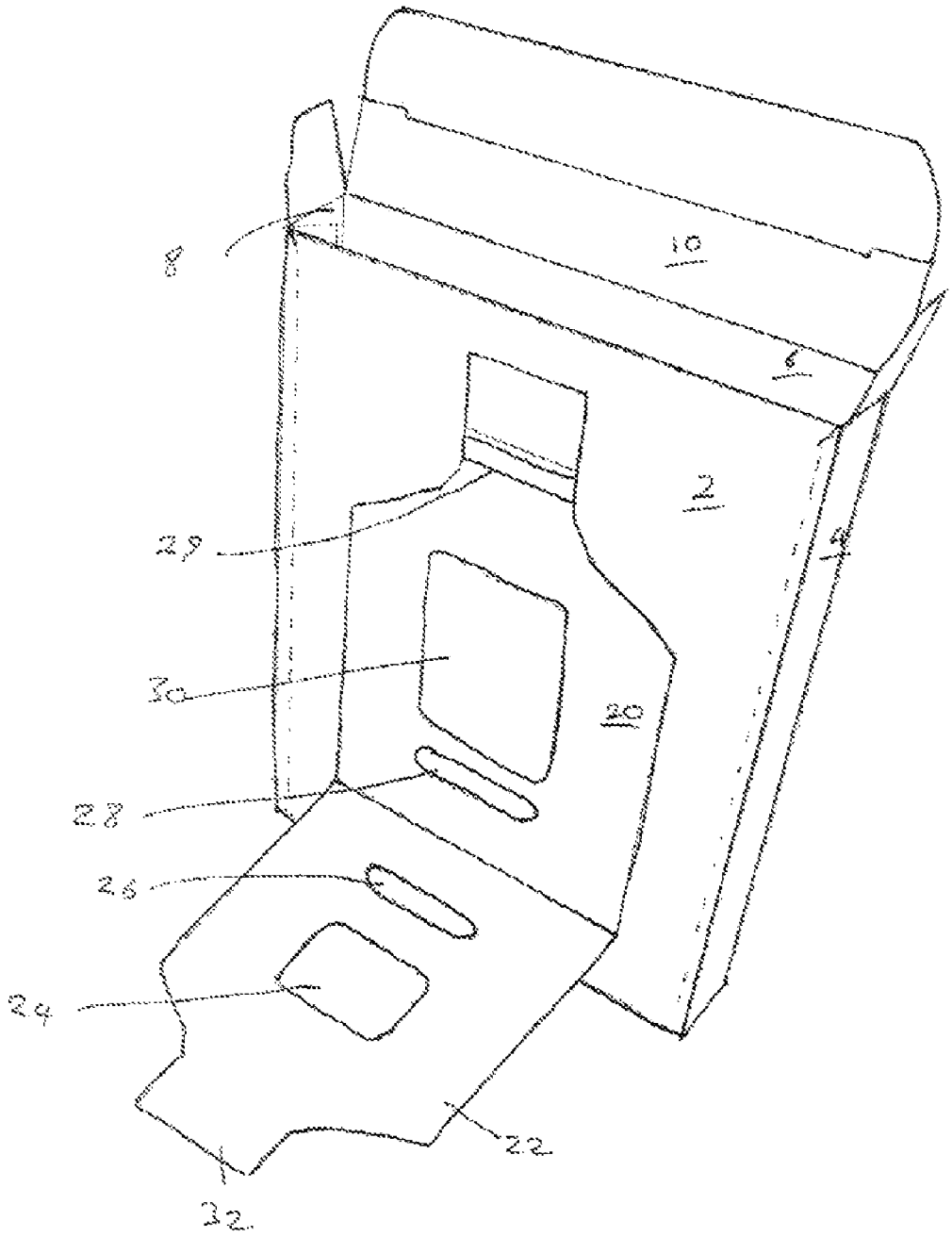
FIG. 3 is a perspective view of the carton of FIG. 2 with the openable tab released to access the insert.
Figure 4:
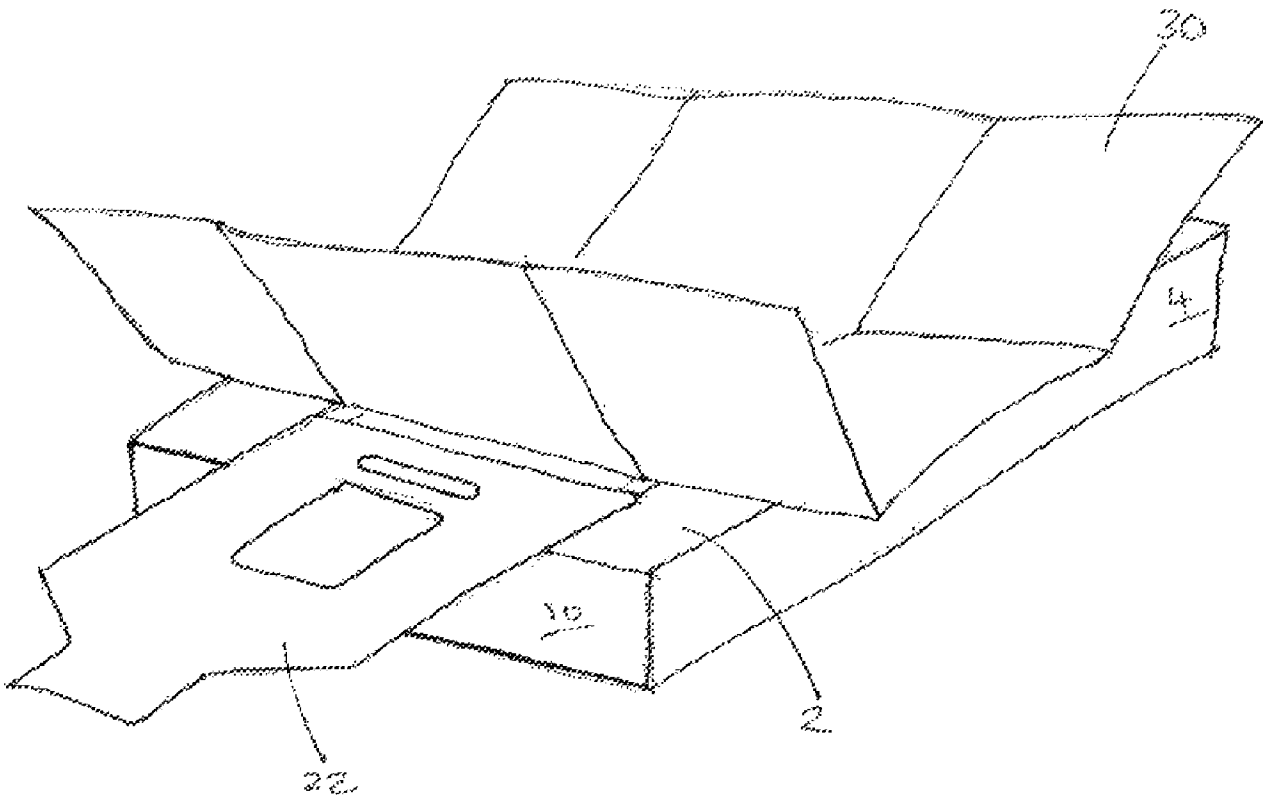
FIG. 4 is a further perspective view of the carton of FIG. 2 with the insert unfolded.

A plurality of pre-cut tear lines 21 are provided on the first wall portion 2 to define a detachable or openable tab or flap 22, detachable from said first wall portion 2 along said tear lines 21 and foldable outwardly, as illustrated in FIG. 3.

A first viewing window 24 is provided in a central region of the flap 22 for viewing a portion of the insert 30 in the assembled carton, as will be described below. A second viewing window 26 is provided below the first viewing window and a corresponding aperture 28 is provided on the further panel 20 to be aligned with the second viewing window when the further panel 20 is folded about the fold line 19 to lie against the rear or inner face of the first wall portion 2 for viewing a portion of a product contained within the assembled carton, as will be described below. A slot 29 is provided in the further panel 20 for receiving a tab 32 of the flap 22 to enable closing of the flap, as will be described below.

A number of blanks can be cut from a sheet of card, simultaneously forming the folds lines and tear lines. A folded product information insert 30 (not shown in FIG. 1) is then affixed by adhesive to the reverse side of the further panel 20 of each blank. The further panel 20 can then be folded back about fold line 19 to lie against the inner or rear face of the first wall portion 2 to enclose the insert 30 within a closed chamber defined by the first wall portion 2 and the further panel 20. The first window 24 provides a view of a portion of the insert 30 to confirm the presence of the insert and to allow identifying indicia on the insert, such as a bar code, to be read. The second window 26 and the aligned aperture 28 provide a view of the contents of the carton, for example to provide access to a corresponding code or indicia on said contents for verifying the contents of the carton. If desired, adhesive may be applied between the further panel and the first wall portion adjacent the peripheral edges thereof to secure the further panel 20 to the first wall portion 2. The carton can then be formed by folding the wall portions 2,4,6,8 about the longitudinal fold lines 1,3,5,7 and securing the side flap 18 to an edge region of the reverse side of the fourth wall portion 8 by a suitable adhesive. The carton, with the insert 30 attached and enclosed therein, can then be supplied to a pharmaceutical manufacturer in flat form.

Figure 2:
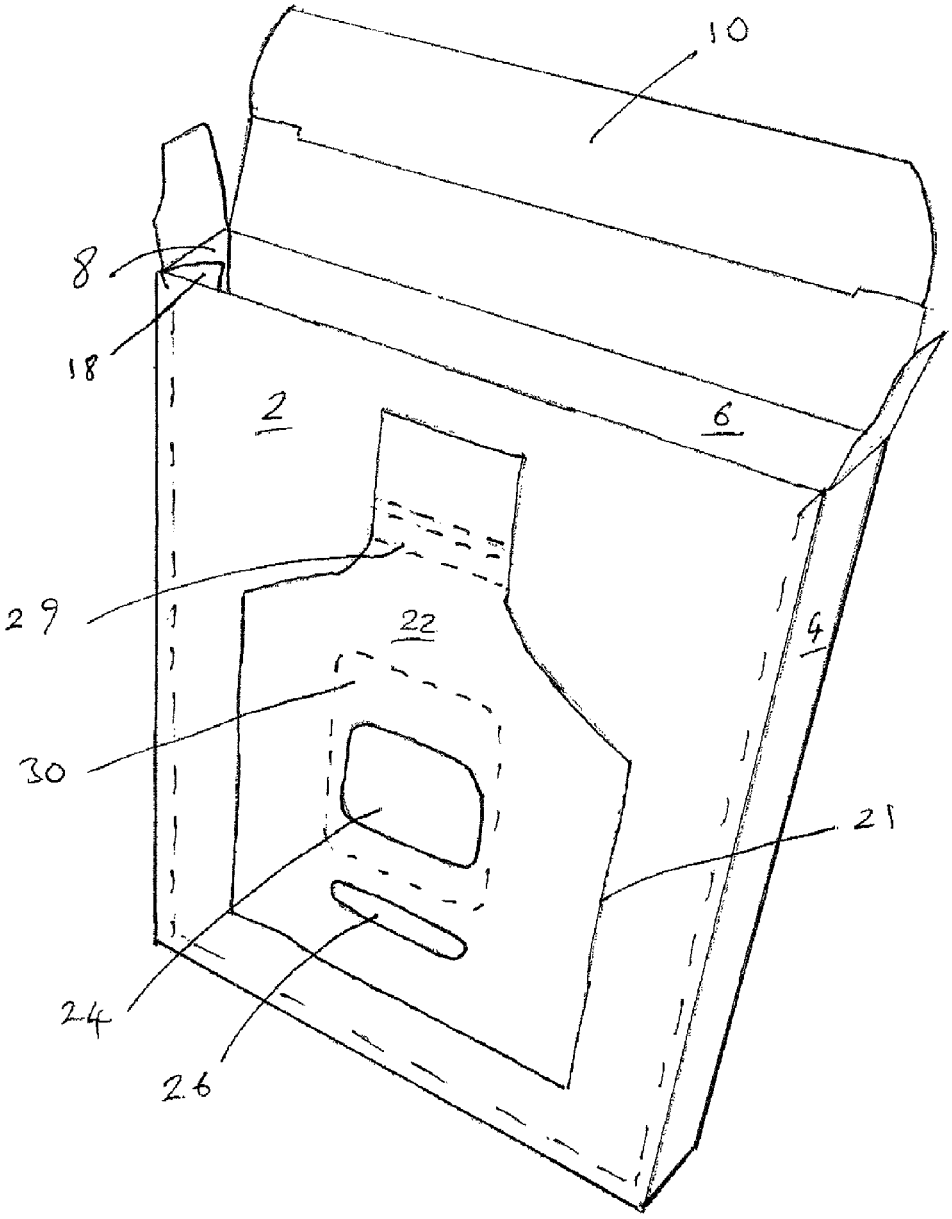
FIG. 2 is a perspective view of a carton according to a first embodiment of the present invention made from the blank of FIG. 1.

In the packaging process, the carton is erected to the form shown in FIG. 2, and the bottom closure flap is folded to close the lower end of the carton. Pharmaceutical products, such as blister packs, can then be inserted through an upper loading opening of the carton. Because the further panel 20 extends from the end of the first wall portion 2 adjacent the loading opening, the closed chamber containing the insert 30 cannot interfere with the loading process. The contents of the carton may be arranged such that a code provided on said contents is visible through said second viewing window 26 in the flap 22 of the first wall portion 2 and the underlying aperture 28 in the further panel 20. At the same time, indicia, such as a bar code, provided on the insert 30 can be viewed through the first window 24 in the flap 22 of the first wall portion 2.

The end user of the product opens the carton by raising the top closure flap 10.

The end user of the packaged product may access the insert 30 by detaching the flap 22 from the first wall portion 2. The insert 30 can then be unfolded and read, as illustrated in FIG. 3. The flap 22 can be subsequently closed by inserting the tab 32 of the flap 22 into the slot 29 in the further panel 20. Independently, the user can gain access to the contents of the carton by opening the top closure flap 10.

Figure 5:
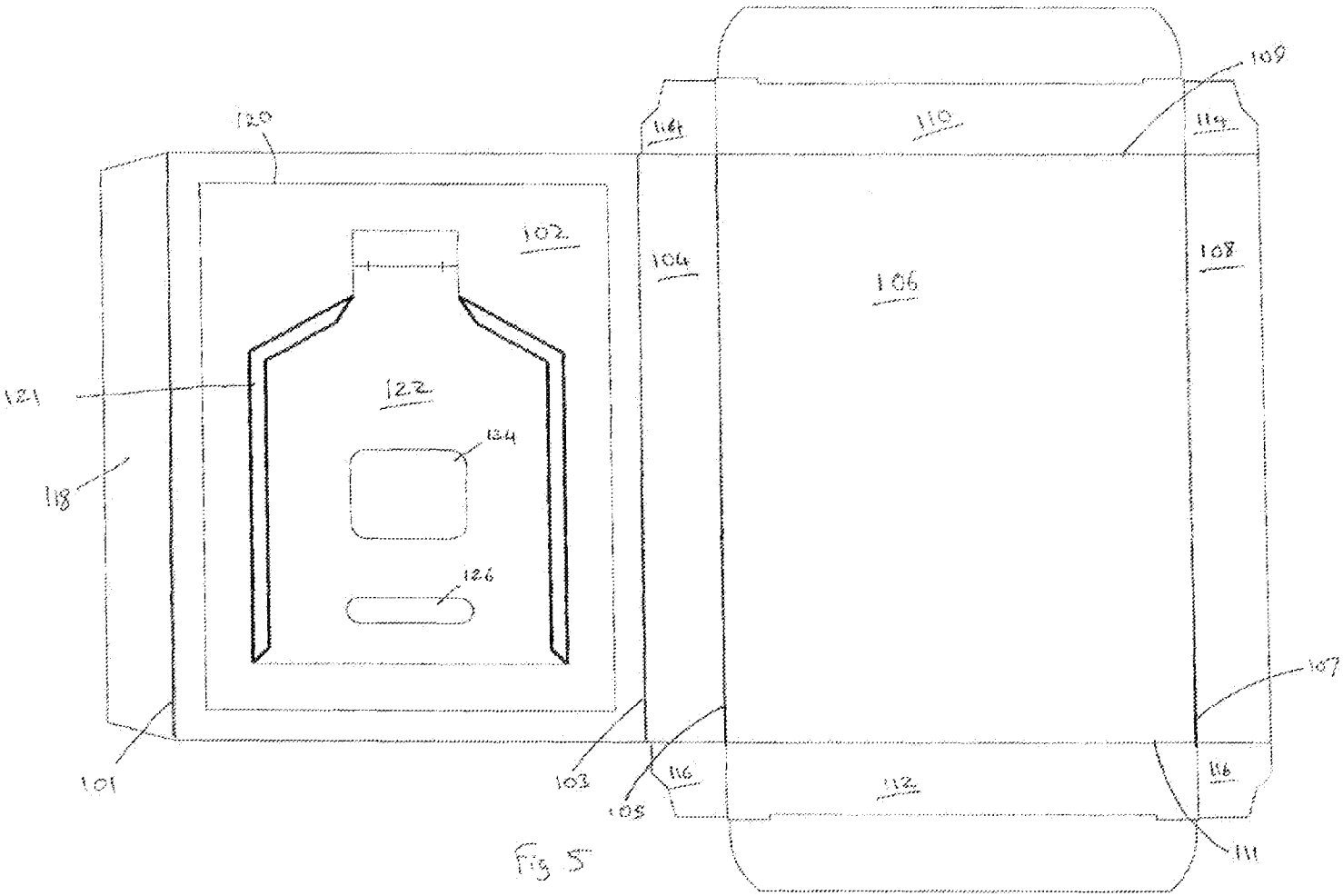
FIG. 5 is a plan view of a flat blank for forming a carton according to a second embodiment of the present invention.
Figure 6:
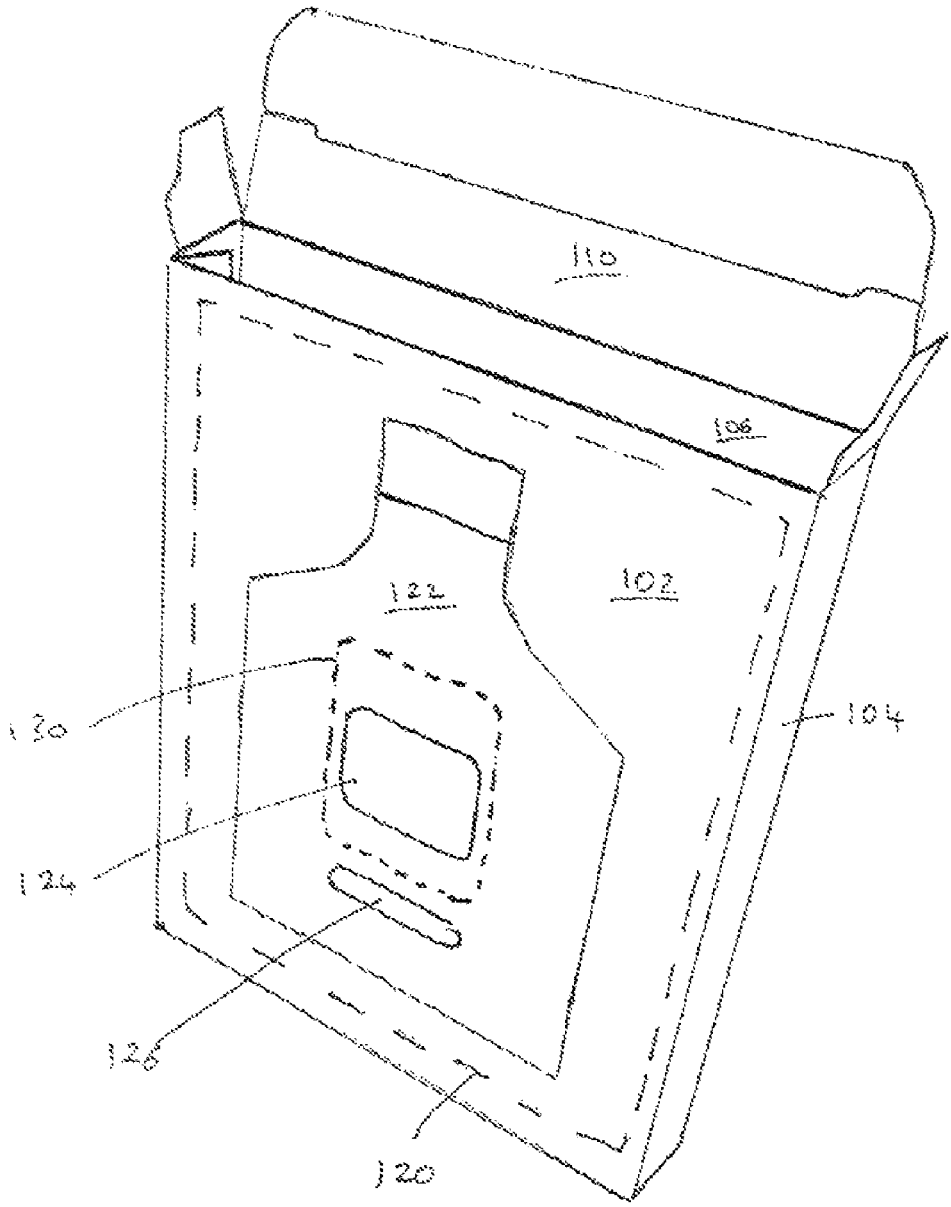
FIG. 6 is a perspective view of a carton according to a second embodiment of the present invention formed from the blank of FIG. 5.

A blank for forming a carton in accordance with a second embodiment of the present invention is shown in FIG. 5. Each blank comprises card sheet having creased parallel longitudinal fold lines 101,103,105,107 defining parallel wall portions 102,104,106,108 and further transverse fold lines 109, 111 defining a top closure flap 110 and a bottom closure flap 12 extending from upper and lower sides of the third wall portion 106.

Top and bottom side flaps 114,116 are present at the top and bottom of two of the wall portions 104,108, and a side flap 118 extends along the long edge of the first wall portion 102.

Figure 7:
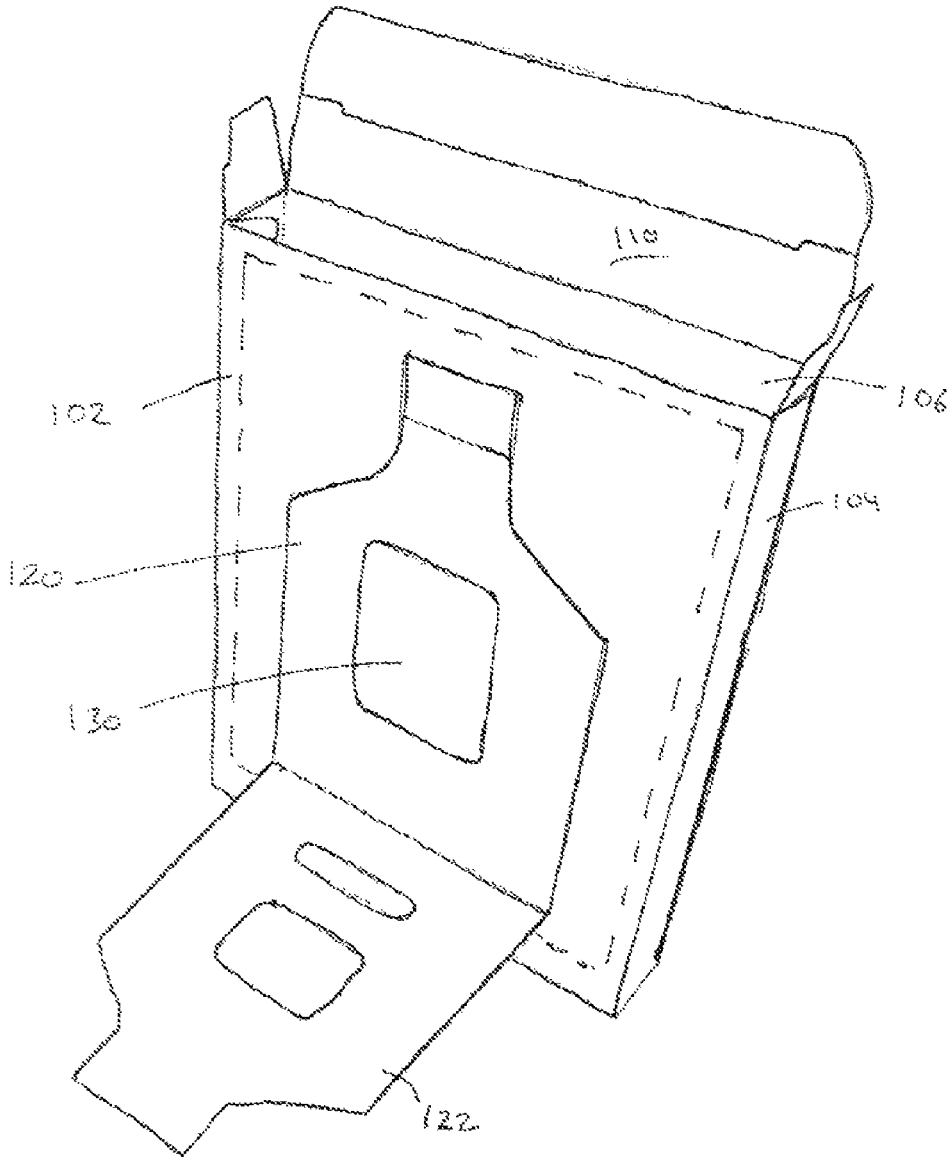
FIG. 7 is a perspective view of the carton of FIG. 6 with the openable tab released to access the insert.

A plurality of pre-cut tear lines 121 are provided on the first wall portion 2 to define a detachable tab or flap 122, detachable from said first wall portion 102 along said tear lines 121 and foldable outwardly, as illustrated in FIG. 7.

A leaflet 130, comprising a backing sheet 120 and a booklet having a plurality of pages or a folded sheet attached to a face thereof, is attached to the rear face of the first wall portion 102 in the region of the flap 122.

A first viewing window 124 is provided in a central region of the flap 122 for viewing a portion of a leaflet 130 affixed behind the flap 122, as will be described below. A second viewing window 126 is provided below the first viewing window. At least a portion of the backing sheet 120 of the leaflet 130 aligned with the second viewing window 126 is formed from a transparent material whereby a portion of a product contained within the assembled carton is visible through said second viewing window 126. Preferably the entire backing sheet 120 of the leaflet 130 is formed from a transparent film.

The backing sheet 120 of the leaflet 130 is securable to the rear face of the first wall portion 102 around a peripheral edge thereof by means of suitable adhesive, such that the printed pages or regions forming the insert of the leaflet are positioned between the backing sheet and the rear face of the flap 122 to be trapped in a closed chamber defined by the backing sheet 120 and the rear face of the first wall portion 102.

A number of blanks can be cut from a sheet of card, simultaneously forming the folds lines and tear lines. A leaflet 130 is then affixed by adhesive to the rear face of the first wall portion 102 of each blank such that the backing sheet 120 of the leaflet is secured to the rear face of the first wall portion 102 around a peripheral edge thereof with the printed regions of the leaflet 130 located between the backing sheet 120 and the first wall portion 102 of the carton. The first window 24 provides a view of a portion of the leaflet 130 to confirm the presence of the leaflet and to allow identifying indicia printed on the leaflet, such as a bar code, to be read. The second window 26 provides a view of the contents of the carton, for example to provide access to a corresponding code or indicia on said contents for verifying the contents of the carton.

Because the backing sheet 120 of the leaflet 130 is secured to the first wall portion 102 around the peripheral edges thereof, the leaflet does not interfere with the loading of the carton.

While the preferred embodiment of the present invention has been described in terms of a carton for a pharmaceutical product, it is envisaged that a carton in accordance with the present invention can be used for packaging a wide variety of products and the present invention is not limited to the packaging of pharmaceutical products.

The invention is not limited to the embodiments described herein but can be amended or modified without departing from the scope of the present invention.

The invention claimed is:

1. An article of packaging in the form of a carton comprising an information-bearing insert enclosed within a substantially closed chamber defined by at least one side wall portion of the carton and a further panel facing an inner face of said at least one side wall portion, said side wall portion having a plurality of pre-cut tear lines defining an openable tab for gaining access to said chamber and to the insert located therein, the carton being provided with a first window through which a portion of the insert is visible in the assembled carton, the carton being provided with a second window through which a portion of a product contained within the carton is visible in the assembled and packed carton, said second window being defined by a second cut-out formed in said at least one side panel and a third cut-out formed in said further panel, said third cut-out being superimposed with said second cut-out in the assembled carton to enable said portion of the contents of the carton to be viewed within the carton, wherein said chamber is not accessible from a loading opening of the carton whereby said chamber does not interfere with the loading of a product into the carton.

2. An article of packaging as claimed in claim 1, wherein said further panel comprises a further wall portion of the carton extending from a side of said side wall portion adjacent a loading opening of the carton, and separated from the side wall portion by a fold line to lie parallel to said side wall adjacent an inner face thereof.

3. The article of packaging as claimed in claim 2, wherein said insert is affixed to a face of said further wall portion facing said side wall portion.

4. The article of packaging as claim in claim 1, wherein said further panel comprises a separate panel adhered to an inner face of said side wall portion around a peripheral edge of said separate panel to define said closed chamber therebetween.

5. The article of packaging as claimed in claim 4, wherein the peripheral edge of said separate panel is adhered to said side wall portion of the carton around said openable tab to enclose said openable tab within the bounds of said peripheral edge, wherein said insert is affixed to a face of said separate panel facing said side wall portion.

6. The article of packaging as claimed in claim 1, wherein said further panel comprises a section of the insert.

7. The article of packaging as claimed in claim 1, wherein said insert comprises a multi-page booklet.

8. The article of packaging as claimed in claim 1, wherein said portion is provided with information, enabling the presence and content of the insert to be checked.

9. The article of packaging as claimed in claim 1, wherein said or window is defined by a first cut-out provided in said at least one side wall portion of the carton, more preferably in said openable tab, arranged to overlay said portion of the insert in the assembled carton.

10. The article of packaging as claimed in claim 1, wherein said second window is provided in said at least one side wall portion of the carton.

11. The article of packaging as claimed in claim 1, wherein said further panel comprises a separate panel adhered to an inner face of said side wall portion, said second window being defined by a second cut-out formed in said at least one side wall portion and a transparent region of said separate panel substantially aligned with and overlying said first cut-out.

12. The article of packaging as claimed in claim 1, wherein said further panel comprises a separate panel adhered to an inner face of said side wall portion, said second window being defined by a second cut-out formed in said at least one side wall portion and a third cut-out formed in said separate panel substantially aligned with said first cut-out.

13. An article of packaging in the form of a carton comprising an information-bearing insert enclosed within a substantially closed chamber defined by a side wall portion of the carton and a further panel facing an inner face of said side wall portion, said side wall portion having a plurality of pre-cut tear lines defining an openable tab for gaining access to said chamber and to the insert located therein, said side wall portion of the carton being provided with a first window for viewing a portion of the insert therebeneath, a second window being defined by a second cut-out formed in said side wall portion, and a third cut-out formed in said further panel, said third cut-out being superimposed with said second cut-out in the carton to enable viewing of an interior of the carton.

14. The article of packaging as claimed in claim 13, wherein said second window is provided in said side wall portion of the carton, spaced from said first window.

15. The article of packaging of claim 13, wherein said third cutout comprises a transparent portion of said further panel.

16. The article of packaging of claim 15, wherein said third cutout comprises an aperture in said further panel arranged to be aligned with said second window.

* * * * *